US006770168B1

(12) United States Patent
Stigsson

(10) Patent No.: US 6,770,168 B1
(45) Date of Patent: Aug. 3, 2004

(54) PROCESS FOR OXYGEN PULPING OF LIGNOCELLULOSIC MATERIAL AND RECORVERY OF PULPING CHEMICALS

(75) Inventor: Lars Stigsson, Saltsjöbaden (SE)

(73) Assignee: Kiram AB, Saltsjobaden (SE)

( * ) Notice: Subject to any disclaimer, the term of this patent is extended or adjusted under 35 U.S.C. 154(b) by 0 days.

(21) Appl. No.: 09/913,409

(22) PCT Filed: Feb. 14, 2000

(86) PCT No.: PCT/SE00/00288

§ 371 (c)(1),
(2), (4) Date: Aug. 14, 2001

(87) PCT Pub. No.: WO00/47812

PCT Pub. Date: Aug. 17, 2000

(30) Foreign Application Priority Data

Feb. 15, 1999 (SE) ..... PCT/SE99/00191

(51) Int. Cl.[7] ..... D21C 1/08; D21C 3/02; D21C 3/20; D21C 11/00; D21C 11/12

(52) U.S. Cl. ..... 162/24; 162/30.1; 162/65; 162/68; 162/72; 162/76; 162/77; 162/79; 162/80; 162/90

(58) Field of Search ..... 162/24, 30.1, 65, 162/68, 72, 77, 76, 79, 80, 90, 37, 38, 39, 40

(56) References Cited

U.S. PATENT DOCUMENTS 3,652,385 A 3/1972 Noreus et al.
3,769,152 A 10/1973 Samuelson et al.
4,004,967 A 1/1977 Swan et al.
4,045,279 A 8/1977 Nagano et al.
4,087,318 A 5/1978 Samuelson et al.
4,808,264 A 2/1989 Kignell

FOREIGN PATENT DOCUMENTS

GB 1 434 232 5/1976

OTHER PUBLICATIONS

Derwent accession No. 1973–29484U, "Cellulose Bleaching With Molecular Oxygen—In Alkaline Medium in Presence of Surfactants", 01–71.

Tappi, Fujii et al., "Oxygen Pulping of Hardwoods", vol. 61, No. 8, 08–78.

*Primary Examiner*—Steve Alvo
(74) *Attorney, Agent, or Firm*—Young & Thompson

(57) ABSTRACT

A substantially sulfur free process for the manufacturing of a chemical pulp with an integrated recovery system for recovery of pulping chemicals is carried out on in several stages involving physical and chemical treatment of lignocellulosic material in order to increase accessibility of the lignocellulosic material to reactions with an oxygen-based delignification agent. Spent cellulose liquor comprising lignin components and spent chemical reagents is fully or partially oxidized in a gas generator wherein a stream of hot raw gas and a stream of alkaline chemicals and chemical reagents is formed for subsequent recycle and reuse in the pulp manufacturing process.

42 Claims, 1 Drawing Sheet

PROCESS FOR OXYGEN PULPING OF LIGNOCELLULOSIC MATERIAL AND RECORVERY OF PULPING CHEMICALS

The present invention relates to a substantially sulfur-free process for the production of a chemical pulp from lignocellulosic material and the recovery of chemicals used in said, process. More particularly, the present invention is related to a process for the production of a chemical pulp in which comminuted lignocellulosic material is subjected to oxygen delignification in the presence of an alkaline buffer solution and chemical substances are recovered from the spent liquor and circulated in the process.

BACKGROUND OF THE INVENTION

Current industrial processes for pulping wood and other sources of lignocellulosic material such as annual plants, and processes for bleaching the resultant pulp, have evolved slowly over many decades. To remain competitive, the pulp and paper industry must seek more cost-effective alternatives to the existing capital-intensive technology for manufacturing of pulp. New investment strategies have to be formulated and implemented to increase shareholder value.

Environmental issues have recently come in focus and in spite of significant advances in this area more can be done to improve the environmental performance of pulp mills. Even the best of current technology is unable to completely suppress the odors emitted in kraft mills, or to completely eliminate the emission of gaseous pollutants and COD compounds associated with chemicals recovery and bleaching. The disclosure of new sulfur-free chemicals and more selective delignification methods combined with efficient recovery systems can lead to substantially better returns for the pulping industry along with environmental benefits.

Pulping of wood is achieved by chemical or mechanical means or by a combination of the two. In thermomechanical pulping (TMP), the original constituents of the fibrous material are essentially unchanged, except for the removal of water soluble constituents. The fibers are, however irreversibly degraded and TMP pulps cannot be used for paper products with high strength demand. In chemical pulping processes the objective is to selectively remove the fiber-bonding lignin to a varying degree, while minimizing the degradation and dissolution of the polysaccharides.

Still stronger pulp is obtained in somewhat lower yields by treating wood chips or other cut-up raw material with chemicals before refining. This type of pulp is called chemical thermomechanical pulp (CTMP). When larger amounts of chemicals are used, but yet insufficient to separate the fibers without refining, the pulp is called chemi-mechanical pulp (CMP).

If the ultimate purpose of the pulp is the preparation of white papers, the pulping operations are followed by further delignification and pulp brightening in a bleach plant. The properties of the end products of the pulping/bleaching process, such as papers and paperboards, will be determined largely by the wood raw material and specific operating conditions during pulping and bleaching.

A low lignin pulp produced solely by chemical methods is referred to as a full chemical pulp. In practice, chemical pulping methods are rather successful in removing lignin. However, they also degrade a certain amount of the polysaccharides. The yield of pulp product in chemical pulping processes is low relative to mechanical pulping, usually between 40 and 50% of the original wood substance, with a residual lignin content on the order of 2–4%. The resulting pulp is occasionally further refined in a bleach plant to yield a pulp product with a very low lignin content and high brightness.

In a typical chemical pulping process, wood is physically reduced to chips before it is cooked with the appropriate chemicals in an aqueous solution, generally at elevated temperature and pressure. The energy and other process costs associated with operation at elevated temperatures and pressures constitute a significant disadvantage for the traditional pulping processes.

The two principal chemical pulping processes are the alkaline kraft process and the acidic sulfite process. The kraft process has come to occupy a dominant position because of advantages in wood raw material flexibility, chemical recovery and pulp strength. The sulfite process was more common up to 1940, before the advent of the widespread use of the kraft process, although its use may increase again with the development of new recovery technologies with a capability to split sulfur and sodium chemicals.

Although the purpose of delignification or chemical pulping processes is to significantly reduce the lignin content of the starting lignocellulosic material, the characteristics of the individual processes chosen to achieve the objective can differ widely. The extent to which any chemical pulping process is capable of degrading and solubilizing the lignin component of a lignocellulosic material while minimizing the accompanying degradation or defragmentation of cellulose and hemicellulose is referred to as the "selectivity" of the process.

Delignification selectivity is an important consideration during pulping and bleaching operations where it is desired to maximize removal of the lignin while retaining as much cellulose and hemicellulose as possible. One way of defining delignification selectivity in a quantitative fashion is as the ratio of lignin removal to carbohydrate removal during the delignification process. Although this ratio is seldom measured directly, it is described in a relative manner by yield versus Kappa number plots.

Another way of defining selectivity is as the viscosity of the pulp at a given low lignin content. Viscosity, however, can sometimes be misleading in predicting pulp strength properties, in particular for modem oxygen-based chemical delignification processes.

The classical methods described above for the delignifl-cation or pulping of lignocellulosic materials, although each possesses certain practical advantages, can all be characterized as being hampered by significant disadvantages. Thus, there exists a need for delignification or pulping processes which have a lower capital intensity, lower operation costs, either in terms of product yield of the process or in terms of the chemical costs of the process; which are environmentally benign; which produce delignified materials with superior properties; and which are applicable to a wide variety of lignocellulosic feed materials. Such processes should preferably be designed for application in existing pulp mills using existing equipment with a minimum of modifications.

It is known in the prior art that cellulose pulp can be manufactured from wood chips or other fibrous material by the action of oxygen in an alkaline solution. However, the commercial use of oxygen in support of delignificafion today is limited to final delignification of kraft or sulfite pulps.

The oxygen pulping methods considered.in the prior art for the preparation of full chemical pulps can be divided in two classes: two-stage soda oxygen and single stage soda oxygen pulping. Both single stage and two stage processes have been extensively tested in laboratory scale. In the two stage process the wood chips are cooked first in an alkaline buffer solution to a high kappa number after which they are mechanically disintegrated into a fibrous pulp. This fibrous pulp with a high lignin content is further delignified with oxygen in an alkaline solution to give a low kappa pulp in substantially higher yields than obtained in a kraft pulping process.

The single stage process is based on penetration of oxygen through an alkaline buffer solution into the wood chips. The alkaline solution is partly used to swell the chips and to provide a transport medium for the oxygen into the interior of the chip. However, the main purpose of the alkaline buffer solution is to neutralize the various acidic species formed during delignification. The pH should not be permitted to drop substantially below a value of about 6–7. The solubility of the oxygen in the cooking liquor is low and to increase solubility a high partial pressure of oxygen has to be applied.

There are a number of significant potential advantages with processes for the manufacturing of pulp which primarily use oxygen chemicals for the delignification work:

1) Lower capital intensity and lower investment cost relative to conventional kraft or sulfite technology
2) Higher overall bleached and unbleached yield
3) Oxygen pulping offers simplified pollution control as there is no source for generating sulfur and odorous compounds such as sulfur dioxide and methyl mercaptans
4) Chemical recovery promises to be relatively simple with substantially less or without causticizing and lime reburning operations
5) Two stage oxygen pulping processes can make use of existing pulping machinery and conversion of a kraft mill to the new technology should be feasible without major reinvestments
6) The cost of oxygen and oxygen-based chemicals has come down significantly in the past years and marginal low-cost oxygen will presumably open for new oxygen applications in a pulp mill Although oxygen pulping was extensively investigated in laboratories and pilot plant scale during the sixties and seventies, no commercial ventures resulted from this effort.

A number of technical challenges must be overcome to arrive at a practical and economical method for using oxygen as a main delignification agent. The major shortcomings and problem areas of oxygen pulping of cellulosic material include:

1) The pulp produced has inferior physical strength properties, partly as a result of non uniform pulping due to slow oxygen mass transfer into the chips
2) So far there has been no disclosure of an efficient process for the recovery of oxygen pulping chemicals and other additives used to support oxygen delignification
3) Prolonged exposure to oxidative conditions results in considerable volumes of spent liquor and dissolved lignin fragments and the spent liquor will consequently have a low fuel value when subjected to wet combustion
4) Carbon dioxide and combustible gases are formed during pulping and continuos venting of the oxygen reactor is necessary with costly and complicated gas cleanup
5) Surplus heat from the exothermic reactions in oxygen pulping can be difficult to dissipate
6) Pulping at low consistency causes large and voluminous liquor handling, while pulping at high consistency may have a negative impact on pulp strength and bleachability Several attempts have been made to accomplish oxygen pulping using mechanical and/or chemical processes, but to the inventor's knowledge none has simultaneously addressed all the problem areas described above and the prior art disclosures do not include or suggest any practical and efficient method for the recovery of pulping chemicals.

For example, Worster et al., in U.S. Pat. No. 3,691,008 discloses a two stage process wherein wood chips are subjected to a mild digestion process using sodium hydroxide, after which the cellulosic material is subjected to mechanical defibration, and then treated under heat and pressure with sodium hydroxide and an excess of oxygen. This process requires a large capacity causticizing stage for all types of lignocellulosic rawmaterials in order to recover the active hydroxide and hence does not give a substantial cost advantage in comparison to kraft pulping. No disclosure is made relating to the recovery of pulping chemicals.

Another example is given in U.S. Pat. No. 4,089,737, wherein cellulosic material is delignified with oxygen which previously has been dissolved into a fresh alkaline medium. The use of magnesium carbonate as a carbohydrate protector is described as well as the use of a two stage reaction zone design with liquor transfer between the stages. No disclosure is made relating to the recovery of the pulping chemicals.

In U.S. Pat. No. 4,087,318 a manganese catalyst is used to increase the selectivity in an oxygen delignification process. The patent describes a pretreatment step wherein metal ions which catalyze the degradation of carbohydrates are removed before the oxygen delignificadon is carried out. Oxygen pulping is carried out in the presence of a catalytically active manganese compound using sodium bicarbonate as buffer alkali. The reaction temperature ranges from 120 to 160° C. and the liquor-to-wood ratio is in the order of 14:1. No disclosure is made relating to the recovery of the pulping chemicals and catalysts and the problem of obtaining an economically recoverable spent liquor from the pretreatment and pulping stages is not addressed.

U.S. Pat. No. 4,045,257 discloses a process for the production of a chemical pulp from lignocellulosic material and the recovery of chemicals used in said process. The process comprises subjecting a stream of comminuted lignocellulosic material to a pretreatment in the form of precooking and defibration of the precooked material followed by reaction of the thus pretreated lignocellulosic material with an oxygen-containing gas in the presence of an alkaline buffer solution in order to obtain a stream of at least partially delignified lignocellulosic material, spent liquor being extracted from both the precooking and the pulping steps and subjected to wet combustion for recovery of chemical substances from the spent liquor to be recirculated in the process. The only route for recovery of chemicals suggested in U.S. Pat. No. 4,045,257 is a wet combustion process which would be impractical and undesirable for use in practice as unavoidable formation of large quantities of carbon dioxide during wet combustion would cause excessive corrosion and undesirable formation of alkali bicarbonates in the pulping liquor. The chemical environment in a wet combustion reactor would also fully oxidize any inorganic and organic chemicals and additives or additive precursors used which may result in their complete inactivation. Wet combustion is not particularly energy efficient and recovery of high pressure steam for electricity generation or formation of a valuable synthesis gas is not possible.

OBJECTS OF THE INVENTION

It should be apparent from the background discussion above that there exists a need for delignification or pulping processes which have a lower capital intensity and which are environmentally superior to the traditional kraft process and at the same time include an efficient system for the recovery of energy and chemicals from the spent cellulose liquor.

It is thus a major object of the present invention to provide a low capital intensity and environmentally superior process for the manufacturing of a chemical pulp combined with an efficient process for the recovery of pulping chemicals.

Another object of the present invention to provide a chemical pulping process with a higher yield relative to the present kraft process.

Yet another object is to provide a process for the manufacturing of a chemical pulp with a minimum or without the need for causticizing and lime reburning capacity.

Another object of the present invention is to substantially reduce the environmental impact in the manufacturing of chemical pulp by substantially eliminating the use of sulfur components in the process, and wherein the generation of malodorous gases is essentially eliminated.

A still further object is to provide a pulping process of the foregoing character wherein the bleachability of the pulp is improved relative to the kraft pulp.

A further object is to provide a chemical pulping and chemicals recovery process that can be applied in existing kraft mills with a minimum of modifications.

The nature of still other objects of the invention will be apparent from a consideration of the descriptive portion to follow, and accompanying figures.

DISCLOSURE OF THE INVENTION

The process of the present invention relates to a substantially sulfur free process for the manufacturing of a chemical pulp with an integrated recovery system for recovery of pulping chemicals. The subject process is carried out on in several stages wherein the first stage involves physical and chemical treatment of lignocellulosic material such as wood or annual plant material in order to increase accessibility of the lignocellulosic material to reactions with an oxygen-based delignification agent. Following the chemical and physical pretreatment the material is reacted with an oxygen-containing gas in the presence of an alkaline buffer solution and in the presence of one or more active chemical reagents in order to obtain a delignified brown stock pulp. The brown stock pulp can, if desired, be bleached with environmentally friendly chemicals such as ozone and hydrogen peroxide in order to obtain a final pulp product with desirable physical strength properties and brightness. The spent cellulose liquor generated in the process comprising lignin components and spent chemical reagents is concentrated followed by full or partial oxidation in a gas generator. In the gas generator a stream of hot raw gas and a stream of alkaline chemicals and chemical reagents is formed for subsequent recycle and reuse in the pulp manufacturing process.

Accordingly in its broadest aspects the present invention is directed to an oxygen delignification process for the production of a cellulose pulp using environmentally friendly chemicals combined with a practical and efficient chemicals recovery system for the recovery of pulping chemicals.

According to the present invention there is provided a process for the production of a chemical pulp from lignocellulosic material and the recovery of chemicals used in said process as set forth in independent claim 1. Further features and specific embodiments of the invention are set forth in the dependent claims 2–38.

a) Feed Material Preparation

Pulp quality can be drastically affected, not only by the quality and origin of the lignocellulosic material and the pulping process, but also by the process of mechanical size reduction such as chipping. Many mills rely on purchased chips generated by outside facilities such as saw mills and plywood mills and these chips may have to be screened and rechipped at the mill to acquire the appropriate size distribution. Some of the non wood materials does not have to be reduced in size or be mechanically treated before impregnation and pulping.

Oxygen alkaline pulping occurs by the transfer of oxygen from the gas bulk into the liquid and thence by diffusion into the reactive sites in the lignocellulosic material. Delignification proceeds at a rate which is a function of the rate of diffusion of active oxygen into the material. It is therefore of great importance to fractionate woody raw materials into small and uniform chips or slivers to render the material accessible to pulping chemicals. Wood chippers are well known to reduce trees, limbs, branches, bushes and the like to wood chips. Chippers come in a wide variety of sizes and power ratings to handle wood material of varying sizes.

Wafer chippers have also been used to produce chips for pulping. Such chippers or waferizers as they are sometimes called, cut generally along (parallel to) and across the grain with the main cutting edge parallel to the grain to produce chips that have a uniform thickness and therefore achieve a more uniform impregnation characteristic. However, the benefits derived from wafer chips can only be obtained if exclusively wafer chips are used. Although this type of chipper is advantageous for preparation of uniform chips with a high accessible surface, the chipper is more expensive to maintain since it generally requires the use of a plurality of discrete knives, each of which cuts a single chip.

It has also been proposed to treat chips produced by a conventional chipper with a shredder to render them more porous and more accessible to the pulping chemicals.

It is also proposed to crush chips using a chip crusher which utilizes a pair of rollers to crush the chips and fissure them to render them more easily and more uniformly penetrable by cooking liquor in the pulping process.

It is critical to rhaintain the integrity of the fibers during chipping or waferizing as a damaged fiber cannot be restored during the following treatments. Excessive chipping or grinding may well ruin the inner structure of the chip with negative consequences on pulp product quality.

In order to soften and swell the lignocellulosic material such as wood before final mechanical destructuration in a chipper or waferizer, the woody material can be soaked in an alkaline solution such as a sodium carbonate solution.

The soaking treatment in the alkaline solution may be by a simple covering of the woody material with the liquid alkaline solution. It is advantageous to remove entrapped air in the woody material by steam or vacuum before soaking. The temperature during the alkaline treatment step should be in the range of 0° C. to 50° C.

The concentration of alkali in the alkaline solution is in the range of 0.001 to 2.5 molar. The alkaline solution to bone dry wood ratio could be between 1:1 and 50:1. The duration of the pretreatment is from 20 minutes to 3 days so long as the particle structure is thoroughly penetrated.

Because uniformity and chip size, in particular chip thickness, are of importance in modem pulping processes, process optimization demands that thickness be controlled. Recent developments in chips screening provide this capability by screening based on thickness.

Although the description above refers to the comminution of woody material, other lignocellulosic materials can be used to prepare chemical pulps in accordance with the present invention. Such materials indude a wide range of lignocellulosic annual plants, rice, kenaf and bagasse.

Of the woody materials, hardwoods such as eucalyptus, acacia, beech, birch and mixed tropical hardwood are preferred raw materials as they are easier to pulp but softwoods such as pine, spruce and hemlock can also be used for the preparation of high quality pulp by the process of the present invention.

Sawdust and wood flour as well as wood splinters and slivers can also be used for the preparation of a chemical pulp in accordance with the present invention without any preceding chipping or destructuration. Any lignocellulosic material with an open structure including most of the non wood material can be charged directly into the pretreatment step of the present invention after optional presteaming to remove entrapped air.

b) Feed Material Pretreatment

It is well known that in all oxidative treatments of cellulosic material, the presence of transition metals plays a significant and often negative role. Thus the removal of the transition metals before oxidative treatments would normally be advantageous. It is also well known that transition metals, particularly in the form of complexes with organic or inorganic structures, increases the rate of delignification and in accordance with the present invention metals with designed catalytic properties can be added after removal of the randomly active transition metal species entering with the lignocellulosic feed material.

Among the pretreatment techniques suggested for the removal of metal ions from wood chips it has been found that treatment with acid (acid wash) is rather effective in solubilizing the undesired metals.

Realizing the difficulties in adopting this type of treatment in mill scale, another method for metals removal is preferred in the practice of the present invention. It is suggested that a mild prehydrolysis of the chips, preferably in combination with addition of an acid and a complexing agent, is more effective than a simple acid wash for the removal of transition metals. Furthermore, such a treatment would remove some of the easily degradable hemicelluloses, thus facilitating the accessibility of reactants to the interior of the wood structure. The removal of some of the hemicelluloses would also decrease the alkali requirement in subsequent pulping operations as the amount of acid degradation products is reduced.

The objective of prehydrolysis in the pretreatment procedure of the present invention is not to remove all the hemicellulose as in the preparation of dissolving pulps. The prehydmlysis process for production of dissolving pulps, as extensively described scribed in pulping handbooks, emphasizes the importance of running the prehydrolysis at high temperatures on the order of 170° C. and higher for up to two hours. Such a treatment would, in contrast to the mild prehydrolysis used in the present invention, remove essentially all the hemicelluloses from the wood.

A variant of prehydrolysis in this context is autohydrolysis which essentially is a steam hydrolysis of the. lignocellulosic material at temperatures of 175–225° C., with a major emphasis on the extractability of lignin by dilute alkali. Under autohydrolysis conditions, the hemicellulose components, as in prehydrolysis, are solubilized and the lignin is partially hydrolyzed by cleavage of α-aryl and phenolic β-O-4 ether linkages.

In yet another variant of prehydrolysis, called steam explosion autohydrolysis, the wood material is treated with steam at a temperature of 200–250° C. for a couple of minutes. This treatment is followed by an explosively rapid discharge to disintegrate the cellulosic substrate. In this type of process both chemical and mechanical attacks on the cellulosic material leads to extensive depolymerization of the carbohydrates. Although this type of pretreatment can be used in conjunction with the practice of the present invention, lower physical strength properties in the pulp product have to be accepted.

In the wood pretreatment stage of the present invention a relatively mild prehydrolysis step can be carried out by the injection of steam into the lignocellulosic material or into an aqueous slurry of the lignocellulosic material. The temperature should be maintained between 50–150° C. under a time period of about 5 to 140 minutes, preferably between 50 and 120° C. under 20 to 80 min. The prehydrolysis may be carried out in the presence of an aqueous neutral or acidic solution and a complexing agent.

The mild conditions during prehydrolysis prevent undesired depolymerization of cellulose while a major part of the transition metals and some of the hemicellulose can be removed. The mild prehydrolysis can be carried out in any suitable type of reactor such as a preimpregnation vessel or steaming vessel normally installed upstream a standard continuous kraft digester.

The acidic liquor resulting from the pretreatment should preferably be removed from the cellulosic material before the pulp is subjected to further treatment. The liquor can be removed through extraction strainers by washing or by pressing the cellulosic material. After optional recycling the spent liquor is discharged from the pretreatment step.

Suitable acidic solutions for use in the pretreatment step include the inorganic acids such as nitric acid, hydrochloric acid and phosphoric acid. Sulfurous acids should not be used as sulfur is a non process element and, if accumulated, has to be removed from the closed or semi closed chemicals cycle in the present invention. Organic acids such as acetic or formic acid can be used however the cost of these acids may be too high to make them attractive.

Acidic liquors and bleach plant filtrates can be used for pH control in the pretreatment stage of the present invention. In a preferred embodiment of the present invention acid bleach plant filtrates from acidic pulp treatment stages in the bleach plant are recycled to the pretreatment stage. Other filtrates can also be used in the pretreatment stage of the present invention, such filtrates includes filtrates from acidic delignification or bleaching stages such as filtrate from an ozone and/or a chlorine dioxide stage.

The pH during the mild pretreatment stage of this invention is not critical, but for optimum metals removal the pH level can be adjusted to any suitable value in the range between about 0.5 to 7.0 preferably to a level between 1.0 and 5.0.

A complexing agent with the capability of forming chelates with the transition metal can advantageously be added to the mild prehydrolysis stage to increase metals removal efficiency. Such agents are exemplified by mixtures of acids from the group of aminopolycarboxylic or aminopolyphosphonic acids or their salts of alkaline metals. Specifically, diethylenetriamine pentaacetic acid (DTPA), nitriloacetic acid and diethylenetriamine pentamethylenephosphonic acid (DTMPA) are preferred sequestering agents. Other efficient complexing agents include phosphorous compounds such as polyphosphoric acids and their salts such as sodium hexametaphosphate and di- or tri-phosphates such as pyrophosphate.

A pulping catalyst and/or a compound to prevent self-condensation of lignin during the prehydrolysis can be added to or immediately after the prehydrolysis stage as an agent active in enhancing selective delignification. Such catalyst or compound may be selected from aromatic organic compounds with a capability to undergo single electrophilic substitution with lignin fragments such as for example 2-naphthol and xylenols and other aromatic alcohols. Useful catalysts include the well known anthraquinone type of pulping catalysts referred to below. The quantity of catalyst to be added in this position may vary in a wide range from about 0.1% on wood up to 5% on wood.

The original concentration of transition metals in lignocellulosic fibrous materials such as wood vary to a great extent depending on wood type, geographical region, age of wood etc. The cobalt and iron concentration in the wood raw material is often rather low, 2–5 ppm, while manganese compounds can be present in concentrations of up to 70–80 ppm.

After removal of a major portion of the transition metals the cellulosic material can be subjected to further treatments before the alkaline delignification stage c) of the present invention. In one specific embodiment of the present invention the cellulosic material is pretreated with oxidants such as an oxygen containing gas, hydrogen peroxide, ozone, chlorine dioxide or a peroxyacid compound such as peroxyacetic acid. This type of treatment has a dual function in stabilizing the carbohydrate towards peeling and increase the lignin defragmentation and solubilization in downstream alkaline treatments of the lignocellulosic material.

The specific physical conditions used during the various forms of pretreatment described herein, although important to achieve the objectives of the pretreatment, are not an innovative part of the present invention. By a person skilled in the art, these conditions are readily determined on a case by case.

After the cellulosic material has been subjected to any of the treatments described above, the material may optionally be precooked in the presence of an alkaline buffer optionally comprising chemical additives to promote delignification or inhibit carbohydrate degradation. The major objective of the precooking step is to soften and swell the lignocellulosic material and simultaneously dissolve at least a fraction of the lignin and hemicellulose before further treatments of the cellulosic material.

The pulping liquor used in such precooking stage contains an alkaline buffer such as an alkali metal hydroxide or carbonate. Other buffering agents can be employed such as alkali metal phosphates and alkali metal boron compounds. The most preferred buffer solution comprises sodium hydroxide, sodium carbonate or sodium borates or mixtures of these compounds. The alkaline buffer solution originates in the chemicals recovery system of the present invention from where it, with or without partial causticizing, is recycled and used as buffer alkali in the precooking stage. The minimum use or even omission of a causticizing stage is a specific feature of the present invention and a major advantage relative to kraft pulping chemicals recovery.

When carbonate based alkali is used as a buffer component, carbon dioxide may be liberated during the precooking and gases may have to be vented from the reactor vessel continuously or from time to time. A high partial pressure of carbon dioxide retards the delignification, and uncontrolled variations in the carbon dioxide content of the pulping liquor make control of the precooking process difficult.

Whether alkali carbonate, or borate's, or a mixture thereof is used, it is suitable to add the alkaline buffer solution incrementally during precooking. Ultimately, the addition is controlled to maintain the pH within the range from about 7 to about 11.

The temperature in the precooking stage is maintained within the range from about 110° C. to about 200° C., preferably from about 120 to 150° C.

At the higher precooking temperatures, a shorter retention time in the reaction vessel is required. A retention time of 3 to about 60 minutes can suffice at 150 to 200° C., while from 60 to 360 minutes may be necessary to obtain the desired result at precooking temperatures lower than about 130° C.

An oxygen-containing gas may optionally be present during precooking and a gas phase digestion procedure can advantageously be used. Otherwise, preimpregnation vessels and traditional types of single or dual vessel continuous digesters of the hydraulic or steam liquor phase type as well as batch digesters where the wood material is retained in the reaction vessel throughout the precooking procedure may be employed to contain the precooking reactions.

The recovery of spent liquors from these steps can be integrated in a known manner with the recovery of spent liquors from the oxygen delignificaton stage of the present invention. The liquors can be concentrated by evaporation and combusted in a separate combustor or gasifier or mixed with other spent liquors for further treatment.

Delignification catalysts and other additives can be added to the precooking stage of the present process. Some of these additives are commonly used to increase the rate of delignification during alkaline digestion of cellulosic materials.

Specific polyaromatic organic compounds can be added to the precooking stage, such compounds including anthraquinone and its derivatives such as 1-methylanthraquinone, 2-methylanthraquinone, 2-ethylanthraquinone, 2-methoxyanthraquinone, 2,3-dimethylanthraquinone and 2,7-dimethylanthraquinone. Other additives with a potential beneficial function in this stage include carbohydrate protectors and radical scavengers. Such compounds include various amines such as triethanolamine and ethylenediamine and alcohols such as methanol, ethanol, n-propanol, isobutyl alcohol, neopentyl alcohol and resorcinol and pyrogallol.

Anthraquinone and its derivatives and alcohols, alone or in combination constitute the preferred organic additives for use in the precooking stage of the present invention. The anthraquinone additives are preferably used in quantities not exceeding 1% of the weight of the dry cellulosic substances and more preferably below 0,5%. Alcohols can be used in higher relative quantities and depending on availability and cost of recovery, up to 10% calculated on dry cellulosic material can be used. A preferred range of alcohol addition, however is below about 3%.

A few specific inorganic compounds can also be used as carbohydrate protectors In the precooking stage of the present invention. Examples of such inorganic compounds are magnesium and silicon compounds, hydrazines, boron hydride of alkaline metals and iodine compounds.

The optimum operating conditions and chemical charges in the precooking stage of the process, according to the invention, depend on several parameters such as the source and origin of the cellulosic raw material, the end use of the product etc. These specific conditions may be readily be determined for each individual case.

After treatments as discussed above the cellulosic material could optionally be subjected to a mechanical treatment in order to liberate the fibers, facilitating efficient contact between the reactants in a following oxygen delignification stage. This can be achieved, in its broadest sense, by introducing a fibrous accumulated material into a treatment apparatus in which the fibres are, at least partially, loosened from each other by breaking the chemical bonds between individual fibres and by leaving the bonds effected by physical forces essentially undisturbed. Further ther defibering of the treated fibre accumulations may be performed by subjecting the material to shear forces of sufficient strength to substantially and completely separate said fibres without cleaving or dividing the solid, chemically bonded particles within the fibre accumulations.

It is important to preserve the fibres from excessive damage during mechanical defiberization. Using modern mechanical pulping technology pulps can be produced in high yields which have strength properties approaching those of the chemical pulps, while at the same time retaining the opacity and bulk properties unique to the mechanical pulps. When the lignin is softened by heating the lignocellulosic material with steam before and during refining under pressure, the separated fibers make significantly stronger paper.

In a specific embodiment of the present invention the lignocellulosic material is pretreated in accordance with any of the methods described above and thereafter subjected to mechanical defiberization before the oxygen delignificabon stage c). The first unit operations in such a sequence have great similarities with the CTMP and CMP pulp manufacturing processes and these type of pulps can be used directly as a feed material to the oxygen delignification stage c) of the present invention.

The Asplund process was developed several years ago and the principles used in this process can be applied in a mechanical defiberization stage. This process involves presteaming of the lignocellulosic material at temperatures above the glass transition temperature of lignin, 550–950 kPa steam pressure at 150 to 170° C., prior to refining between revolving disks or plates. The lignin is sufficiently soft that separation occurs at the middle lamella, and fibers are left with a hard lignin surface that is readily accessible to the chemicals in a following oxygen delignification stage.

The most important parameter to control the mechanical defiberization process besides the various pretreatments and the temperature during refining is the energy input in the refiners. For TMP pulps the energy input can be as high as 1500–2500 kWh/ton of pulp. In the mechanical defiberization stage of the present invention the energy input shall be kept as low as possible keeping in mind that the only objective of defiberization is to make the lignocellulosic material more accessible to down stream chemical treatments. The range of energy input necessary will obviously vary dependent on the origin and specification of the raw material and nature of pretreatment, but is generally on the order of 50–500 kWh/ton of material and more preferably between 50 and 300 kWh/ton.

c) Oxygen Delignificatcion

Oxygen delignification and bleaching with oxygen-based molecules have become increasingly popular in conjunction with the manufacturing of kraft pulp and the cost of oxygen chemicals has come down significantly. The oxygen delignification stage of the present invention, following the pretreatment, is performed in one or preferably two or more stages.

In analogy with the precooking step discussed above, an alkaline buffer is also present during oxygen delignification. The alkaline buffer agent may contain alkali metal carbonate or bicarbonate. Other buffering agents can be employed such as alkali metal phosphates and alkali metal boron compounds. The most preferred buffer solution comprises sodium carbonate, sodium bicarbonate or sodium borate's or mixtures of these compounds. The alkaline buffer solution originates in the chemicals recovery system of the present invention from where it is recycled for use in the oxygen delignification stage without having been subjected to causticizing reactions with lime.

The alkaline buffer can be supplied to the oxygen delignification stage as such, but it is also possible to add alkali metal hydroxides to increase the alkalinity of the buffer solution. When carbonate or bicarbonate is used as a buffer component, carbon dioxide may be liberated during oxygen delignification and gases may have to be vented from the reactor vessel continuously or from time to time. A high partial pressure. of carbon dioxide retards the delignificaUon, and uncontrolled variations in the carbon dioxide content of the pulping liquor make control of the oxygen delignification process difficult.

Whether alkali bicarbonate, carbonate, or borates, or a mixture thereof is used, it is suitable to add the alkaline buffer solution incrementally during oxygen delignification. Ultimately, the addition is controlled to maintain the pH within the range from about 7 to about 12.

The oxygen added to the oxygen delignification stage can either be pure oxygen or an oxygen containing gas, the selection based on oxygen cost and partial pressure needed in the reactor. The total pressure in the reactor is made up of the partial pressure of steam, oxygen and other gases injected or evolved as a result of the reactions in the oxygen delignification process. The partial pressure of oxygen should be kept in the range of from 0.1 to 2.5 MPa.

The oxygen is preferably prepared on site by cryogenic, swing adsorption or by membrane technology in order to prepare a low cost stream of oxygen containing gas. Oxygen may have several applications in the pulp mill but the main users are oxygen delignification and oxidation of the cellulose spent liquors formed in the present process. Oxygen gas can first be passed in surplus through the oxygen delignification stage and unreacted gas, eventually also comprising other gases such as carbon oxides, is discharged from the oxygen delignification stage, compressed if necessary, and injected in a reactor for oxidation of cellulose spent liquor.

The quantity of oxygen consumed in the present oxygen delignification stage varies considerably dependent on factors such as wood material, kappa reduction and degree of wet combustion of lignin fragments but is normally in the order of 50–200 kg per ton of lignocellulosic material.

Oxygen bleaching and oxygen delignification are very complex processes involving a variety of simultaneously proceeding ionic and radical reactions acting on the lignocellulosic material.

Molecular oxygen is a ground state triplet. The initial step in oxygen bleaching therefore involves an outer sphere one electron transfer from a center of high electron density in the lignocellulosic structure (substrate) to give the first reduction product of oxygen, the superoxide anion radical and a substrate radical. Under the conditions prevalent in alkaline oxygen delignification the phenolic groups in the lignin are ionized and the substrate radical is mainly of the phenoxyl radical type. The next step in the reduction of oxygen under these conditions is the formation of hydrogen peroxide through dismutation of the superoxide anion. The superoxide anion itself is not very reactive but the decomposition products of hydrogen peroxide includes the hydroxyl radical, a very reactive and indiscriminate specie. The hydroxyl radical not only reacts with the lignin structures but also very readily attacks the polysaccharides with subsequent glycosidic bond cleavage and the creation of new sites for peeling reactions. The depolymerisation of the polysaccharides eventually affects the pulp strength properties and oxygen delignification is normally terminated before excessive depolymerisation takes place. It is nevertheless understood that the hydroxyl radicals must be present during oxygen delignification to effect defragmentation of the lignin.

The presence of hydroxyl radicals during oxygen delignification is partly an effect of metal ion catalyzed decomposition of hydrogen peroxide. Control of the metal ions alone or any metals combined with various coordination spheres and ligands is of instrumental importance.

Only the metals that can occur in two valence states of approximately equal stability in the oxidation medium can act catalytically. These metals indudes cobalt, manganese, copper, vanadium and iron while metal ions with filled d orbitals like $Zn^{2+}$ and $Cd^{2+}$ are inactive as catalysts under the conditions prevailing in the oxygen delignification stage of the present invention.

More specifically, the active transition metals and their complexes harness the oxidative capability of dioxygen and direct its reactivity towards the degradation of lignin within the fiber walls. In this process, high valence transition metal ions serve as conduits for the flux of electrons from lignin to oxygen.

The behavior of transition metal ions in water is often difficult to control and in aqueous solution, complex equilibria are established between ionic hydroxides and hydrates, as well as between accessible oxidation states of the metal ions. In addition, many transition metal oxides and hydroxides have limited solubility in aqueous solutions, where the active metals are rapidly lost from solution as solid precipitates. What is needed in the art of oxygen pulping is a recoverable transition metal-derived delignification agent composed of relatively inexpensive and nontoxic material or a true delignification catalyst which can be recyded.

In accordance with the present invention the preferred oxygen delignification catalysts comprises at least one of the metals copper, manganese, iron, cobalt or ruthenium. Specffically preferred are copper ormanganese compounds or combinations of these metals. Although these metals normally also initiate and catalyze undesired reactions, their low cost and ease of recovery in the recovery system of the present invention is a clear advantage. In order to protect the carbohydrates from undesired reactions followed by glycosidic bond cleavage and eventually poor pulp strength properties, the use of these preferred metal ions should preferably be combined with the use of at least one carbohydrate protector.

As the metal ion catalyzed disproportionation of hydrogen peroxide is identified as the key reaction for formation of the extremely active and unselective hydroxide radical this reaction must be controlled in some way. While this observation has considerable merit, it is safe to say that the role of the metal ions can involve more than catalyzing the decomposition of hydrogen peroxide. For example, the metal ions can change the induction periods, change the activation energy for certain reactions or affect the product distributions. A lowering of the activation energy for some of the key delignfication reactions would be very desirable, in particular if the overall reaction temperature can be significantly decreased.

The transition metal redox catalysts of the present invention function by inter changing between two or more valence states. Since the half-cell potential for such changes is a function of the ligand sphere of the ions, the design and nature of the ligand should if possible be selected in view of increasing lignin defragmentation reactions and minimizing the undesired hydrogen abstraction reactions. One problem, however, is that the ligands must be stable towards the vigorous attacks of the radicals in the system.

One of the most important characteristics of an effective oxygen delignification catalyst is the redox potential of the compound. Among the metal complexes with a well defined redox potential close to zero visavi the hydrogen reference electrode, are the Cu and Mn phenanthroline complexes and Cu and Mn 2,2-bipyridyl complexes. These structures are very efficient and selective delignification catalysts partly because their coordination spheres are accessible for the hydrogen peroxide and/or perhydroxyl radical. The desired electron transfer reactions proceed within the coordination sphere of the metal ion promoting the lignin defragmentation reactions.

Rather than altering the reaction mechanism, these transition metal catalysts are acting by lowering the activation energy of certain desired reactions with an increased rate of delignification as a result.

Another catalyst capable of enhancing the selectivity in oxygen delignification systems is the cobalt compound (N,N'-bis(salicylidene)ethane-1,2-diaminato) cobalt, better known as salcomine. This compound and other complexes with Schiff base ligands are known to activate dioxygen and are frequently used as catalysts in the oxidation of organic substrates.

Other nitrogen-containing coordination compounds, although not as efficient as phenanthroline or bipyridyl compounds, can be added to bind and form complexes with the active metals of the present invention. Such compounds include for example ammonia triethanolamine, triethylenetetraamine, diethylene-triamine, acetylacetone, ethylene diamine, cyanide, pyridine and oxyquinolines.

Ruthenium oxide is used as a very selective oxygen transfer specie in organic synthesis's and while not tried, as far as the inventor is aware, in conjunction with oxygen delignification, this compound could potentially be used to support selective delignification in the present invention.

Recently, a class of inorganic metal oxygen cluster ions called polyoxymetallates was proposed as highly selective reagents or catalysts for delignification in oxidative environments. Polyoxometalates are discrete polymeric structures that form spontaneously when simple oxides of vanadium, niobium, tantalum, molybdenum or tungsten are combined under the appropriate conditions in water. In a great majority of polyoxometalates, the transition metals are in an electronic configuration which dictates both high resistance to oxidative degradation and an ability to oxidize other materials such as lignin. The principal transition metal ions that form polyoxometalates are tungsten(VI), molybdenum(VI), vanadium(V), niobium(V) and tantalum (V).

This class of compounds can be used as a catalyst or co-catalyst in the oxygen delignification stage of the present invention, but it would be more preferable to use polyoxymetalates in a final delignification stage located downstream of the oxygen delignification stage.

Another group of catalysts, which includes transition metals such as V, Mo,W and Ti can promote the heterolysis of the oxygen-oxygen bond in hydrogen peroxide and alkylperoxides, the latter components formed during oxygen delignification. Acidic metal oxides such as $MoO_3$, $WO_3$ and $V_2O_5$ catalyze the formation of peracids from hydrogen peroxide. In these peracids the conjugate base of the acid provides an excellent leaving group for nucleophilic displacement For example, the oxidation of iodide, a preferred carbohydrate protector component in the present invention, by hydrogen peroxide is catalyzed by molybdenum compounds through the intermediacy of permolybdic acid.

Although metal complexes with designed coordination spheres and ligands offer a very large potential to promote the desired reactions in the oxygen delignification of the present invention, a major problem is their high cost and it is unlikely that they can be regenerated in a useful form from the spent pulping liquors.

The conclusion is that a cost effective oxygen delignification catalyst either has to be very inexpensive or it has to be recoverable through the chemicals recovery system.

The most preferred catalysts for use in accordance with the present invention are based on inorganic compounds formed in and recycled from the recovery system of the present invention. Such compounds include copper, manganese, iron and cobalt compounds and specifically their oxides, chlorides, carbonates, phosphates and iodides.

These preferred transition metal compounds may act in several different redox systems in the oxygen/lignocellulose environment, either as inorganic catalysts or as electron transfer agents. These metals also form active metal complexes with the dissolved organic structures formed in situ during delignification.

A large portion of the transition metals entering the process with the lignocellulosic raw material has been removed during the pretreatment step of the present invention and fresh catalytically active metals and metal complexes may, as specified herein, be added within or before the oxygen dilignificaton stage. The quantity of metals compounds added must be controlled since a too high concentration not only hinders the initiation of the desired reactions, but also lowers the selectivity because the rate of radical chain oxidation is usually limited by oxygen transport through the liquor to the reactive sites. Too high catalytic activity leads to oxygen deficiency or starvation and the excess radicals are reacting along undesired paths.

The active transition metal catalysts used to enhance oxygen delignification selectivity in accordance with the invention are present in concentrations ranging from 10 ppm to 5000 ppm calculated on dry lignocellulosic material and more preferably in the range of 10 to 300 ppm.

It is thus a major objective of the present invention to control the metal profiles in the oxygen delignification stage by addition of catalytic substances comprising metals or metal complexes combined with addition of carbohydrate protector substances to effect rapid delignification while preventing carbohydrate depolymerisation.

It is normally desired to produce as strong pulp as possible and the preservation of carbohydrates during delignification is specifically important. A low degree of carbohydrate degradation is reflected by a high molecular weight distribution in the pulp and preserved physical strength properties in the pulp product.

In order to protect the carbohydrates from excessive degradation it is desirable to carry out the oxygen delignification stage in the presence of radical scavengers and carbohydrate degradation inhibitors or carbohydrate protectors or mixtures of these substances.

The inhibitors or carbohydrate protectors can act through several different pathways such as hindrance of the formation of the active radicals and intermediates, by lowering their concentrations through complexing or simply by decomposing the undesired species.

It was discovered in the sixties and seventies that carbohydrate degradation during oxygen delignification was retarded by magnesium compounds and triethanolamine as well as by other substances such as silicon compounds and formaldehyde. The inhibiting effect of magnesium compounds is probably an effect of masking the catalytic metals by substitution of divalent Mg by divalent transition metal ions in a solid phase where the anionic component may be hydroxide, carbonate or silicate ions. This would effectively inhibit uncontrolled hydrogen peroxide decomposition to active hydroxyl radicals through the well known Fenton mechanism. Organic amines such as triethanolamine inhibit the degradation of cellulose and hemicellulose by deactivating the catalytic metals through complex formation.

Different radical chain breaking antioxidants can also be used in the present invention to effect conversion of hydroxyl radicals to more stable products. Typical examples in this group of additives include alcohols such as methanol, ethanol, n-prpanol, isobutyl alcohol and neopentyl alcohol, ketones such as acetone, amines such as ethanolamines, ethylenediamine, aniline and resorcinol.

Besides being active antioxidants, some of these additives are also good solvents, improving the dissolution of lignin fragments into the alkaline buffer liquor.

Most preferred organic antioxidant and lignin solvent additives include the alcohols or acetone used alone or in combination. The concentration of these additives can be varied in a wide range. However, if they are present in a concentration higher than about 1% calculated on lignocellulosic material they have to be recovered from the cellulose spent liquor. Preferred concentrations ranges from about 0.1% to 10%, more preferably from 0.5 to 3%.

The most preferred carbohydrate protectors for use in the oxygen delignification stage of the present invention are iodine compounds, magnesium compounds soluble in alkaline solutions or various combinations of these compounds. Besides being very effective carbohydrate degradation protectors these compounds can readily be recovered and recycled by the recovery system of the present invention. Although a number of complex organic compounds has well known antioxidant or radical scavenging capabilities, and certainly can be efficient as carbohydrate protectors, they are associated with a high cost and most probably they cannot be recovered from the spent liquor.

The mechanism of cellulose protection by iodine compounds is related to their ability to decompose hydrogen peroxide. Although reaction stoichiometries in these systems sometimes can be complex, the reaction between iodide ion and hydrogen peroxide is rather simple and can be interpreted in terms of nucleophilic substitution of peroxide oxygen with hydroxyl ion as one of the leaving groups and iodide as a reactant. Iodine is a very strong nucleofil and its is likely that iodine compounds, formed or added to the oxygen delignification stage, scavenge some of the active radicals and the specific mechanisms of the protecting effect of iodine is largely unclear.

Besides their excellent behavior in protecting the carbohydrates in the oxygen delignification stage of the present invention, another major advantage of using inorganic compounds comprising iodine, magnesia or certain nitrogen compounds will become obvious when the chemicals recovery system of the present invention is described in the forthcoming detailed description.

The inhibitors can advantageously be charged together with the alkaline buffer liquor during, or preferably in the beginning of, the oxygen delignification stage.

The amount of protector additive to be present during oxygen delignification is not critical and depends largely on the specific additive and end use of pulp. Normally, magnesia compounds should be used in quantities from about 0.1% on wood up to 2% on lignocellulosic material. Iodine compounds can be used in ranges from about 1% up to 15% on lignocellulosic material but a preferred range is from about 3 to about 8%.

Mass transfer limitations are a serious concern in oxygen delignification systems. Gas to liquid and liquid to solid transfer of oxygen to the reactive sites is constrained by the very low solubility of oxygen gas in aqueous media and it is necessary to design the oxygen delignification reactor and oxygen injection system to ensure as good of mass transfer as possible. The cooking liquor can be allowed to run continuously or intermittently over the chips during the delignification process. Transfer of oxygen to the reaction sites through the pulping liquor can be done either by introducing a source of oxygen into a bulk liquid phase or by flowing dispersed pulping liquor through a gas/chips bulk or by combinations thereof.

Regardless of whether the gaseous or liquid phase dominates the oxygenation process, the mass transfer of oxygen is accomplished by introducing small gas bubbles into the liquid phase. The efficiency of gas-liquid mass transfer depends to a large extent on the characteristics of the bubbles.

It is of fundamental importance to effect an exchange of gases across the interface between the free state within the bubble and the dissolved state outside the bubble. It is generally agreed that the most important property of many oxygenation processes, such as wet oxidation of carbonaceous material, is the size of the oxygen bubbles and their stability.

Small gas bubbles rise more slowly than large bubbles, allowing more time for a gas to dissolve in the aqueous phase. This property is referred to as gas hold-up. Concentrations of oxygen in aqueous solutions can be more than doubled beyond Henry's Law solubility limits in a properly designed gas liquid contactor.

The addition of surfactants andlor polyelectrolytes in accordance with the present invention exhibits desirable properties associated with the formation of microbubbles, micelles or coacervate structures. The formation of microbubbles formed with the surface active composition of the present invention increases the mass transfer of oxygen in liquids.

Without being bound to any specific mechanism, it is likely that the tendency of the surface active composition of the present invention to organize into coacervates, micelles, aggregates, or simply gas-filled bubbles provides a platform for the desired reactions to occur by increasing the local concentration of oxygen.

Perforated gas spargers for introduction of oxygen into the liquor are commercially available. These spargers should be designed to introduce the gas into the liquor as microbubbles.

As large quantities of gas are introduced into the alkaline buffer liquor, the liquid phase can become supersaturated if nucleation centers for the formation of bubb;es bles are absent. At this point microbubbles can then form spontaneously, nucleating large bubble formation, and sweeping dissolved gases from the solution until super saturation again occurs. In the presence of surfactants or polyelectmlytes, it is likely that a larger portion of gas will remain the solution as stable bubbles.

Surface active agents or polyelectrolytes can be added to the pulping liquors or to the oxygen delignification stage of the present invention to increase the mass transfer of oxygen or other compounds such as catalysts to the reaction sites within the chip. Whether by the formation of a foam, or by lowering the viscosity of the cooking liquor, or through formation of micro encapsulated oxygen or catalyst compositions, the addition of a small quantity of surface active agents can have a profound effect on some critical parameters in oxygen delignification.

Adding surface active agents to this stage also contributes to a reduction in the resin content of the cellulosic material, resulting in increased lignin defragmentation and more uniform pulping.

The surface active agent or polyelectrolyte is preferably added to the pulping liquor, or during an early stage of the oxygen delignification process, and may be present during all or only a part of the process. Anionic, nonionic and zwitter ionic polyelectrolytes and surface active agents and mixtures thereof can be used.

The preferred polyelectrolytes indude cross-linked polyelectrolytes such as phosphazenes, imino-substituted polyphosphazenes, polyacrylic acids, polymethacrylic acids, polyvinyl acetates, polyvinyl amines, polyvinyl pyridine, polyvinyl imidazole, and ionic salts thereof. Cross-linking of these polyelectrolytes can be accomplished by reaction of multivalent ions of the opposite charge further enhancing the active properties of the polyelectrolyte.

Specific preferred anionic surfactant materials useful in the practice of the invention include sodium alpha-sulfo methyl laurate, sodium xylene sulfonate, triethanol ammonium lauryl sulfate, disodium lauryl sulfosuccinate and blends of these anionic surfactants.

Non-ionic surfactants suitable for use in the present invention include, but are not limited to, polyether non-ionic surfactants comprising fatty alcohols, alkyl phenols, poly (ethyleneoxy)/(propyleneoxy) block copolymers or fatty acids and fatty amines which have been ethoxylated; polyhydroxyl non-ionic (polyols) typically such as sucrose esters, sorbital esters, alkyl glucosides and polyglycerol esters which may or may not be ethoxylated.

The amphoteric or zwitterionic surface active agent can be an amidated or quaternized poly(propylene glycol) carboxylate or lecithin.

The amount of surface active agent added to the oxygen delignification stage or to the buffer alkali in accordance with the principles of the invention can be up to 2% based on the weight of pulp produced. Preferably, the amount of surfactant and/or polyelectrolyte admixed with the alkaline buffer liquors ranges from 0.001% up to about 2% by weight, based on pulp produced and more preferably ranges from about 0.01% to 0.5% by weight.

A substantial reduction in viscosity can be effected during oxygen delignification by addition of a high molecular weight polyethyleneglycol to the pulping liquor. These water soluble polymers are very effective viscosity reducers and only a minor quantity, on the order of 0.2 percent or less, is needed to achieve the desired viscosity reduction.

Finally, when producing pulps for certain papermaking purposes, it may also be suitable to add peroxides, such as hydrogen peroxide andlor sodium peroxide, or nitrogen oxides to the oxygen delignification stage of the present invention. Additon of these compounds will increase the brightness level in the unbleached pulp which may be quite desirable for certain applications.

The oxygen, delignification process of the present invention can be carried out in several types of commercial oxidation reactors including the reactors normally used in conjunction with oxygen bleaching. The ratio of lignocellulosic material to alkaline buffer solution can vary in a wide range from low consistency systems operating at ratios as low as 1–5% over medium consistency designs at 10–15% to high consistency designs at ratios up to about 30%. See for example T. J., McDonough in "Oxygen bleaching processes" June 1986 Tappi Journal, page 46–52.

Typical gas -liquid-solid phase reactions involves gas-liquid and liquid-solid mass transfer, intraparticle diffusion, and chemical reaction. The relative importance of these individual steps depends on the type of contact in the three phases. Therefore, the choice of reactor design is very important for optimum performance. Typical multi phase reactors can be divided into two classes, depending on the state of motion of the lignocellulosic material.

a) The lignocellulosic material is packed in a slowly moving bed and the fluids may be in either cocurrent or countercurrent up flow or down flow.

b) The lignocellulosic material are suspended in the liquid phase by mechanical stirring A trickle bed reactor is an example of a the first group wherein the liquid flows in rivulets through the slowly moving bed. Trickle beds can be used in the present oxygen delignification stage. More preferred are the reactors of the second group and specifically three phase (gas/liquid/solid) fluidized beds are well suited for the oxygen delignification reactions.

Other types of oxygen delignification reactors indudes tubular or pipeline reactors with or without static mixers.

In a specific embodiment of the present invention, oxygen delignification and/or nitration reactions are carried out in a pressurized diffuser reactor, such reactor normally used for displacement washing of pulp after oxygen deiignification. Continuous diffuser washers are normally mounted on the brown stock storage tank and effect pulp washing. The pulp is passed upwards in the diffuser vessel and passes between a plurality of concentric withdrawal screens. The diffuser reactor comprises generally a pulp slurry inlet at the bottom and a slurry outlet adjacent to the reactor top. The diffuser reactor and its use as a pulp washer is principally described in for example Knutsson, etal., World Pulp and Paper Week Proc., "Pressure diffuser—A New Versatile Pulp Washer"; 97–99 Apr. 10–13, 1984.

d) Brownstock Post Treatment

The brownstock pulp treatment and any pulp processing downstream of the oxygen delignification stage do not form an integral part of the present invention and numerous variants are conceivable.

The brownstock pulp obtained in accordance with the process of the invention can for example either be finally treated to obtain an unbleached pulp product or be bleached using known bleaching agents, such as chlorine, chlorine dioxide, hypochlorite, peroxide and/or oxygen, ozone, cyanamide, peroxyacids, nitrogen oxides or combinations of any such bleaching agents, in one or more steps. When pro ducing refined pulps, such as for the manufacture of rayon, the pulp may be purified by treatment with alkali using known methods.

The alkaline bleach plant filtrates are preferably recycled counter currently back to the oxygen delignification stage. Acidic bleach plant filtrates, specifically those originating from chlorine dioxide, ozone, nitrogen oxide or other acidic treatment stages, are preferably recycled directly or indirectly to a lignocellulosic material pretreatment stage of the present invention.

e) Extraction of Spent Liquor

Spent liquor comprising dissolved lignin components and spent chemical substances is extracted from step c) or both steps c) and b) for the recovery of chemicals therefrom.

f) Chemicals Recovery

The various spent liquor streams generated in the processing stages of the present invention are, with or without extraction of lignin and other organic material, withdrawn to be further processed in the recovery system to recover inorganic chemicals, additives or additive precursors and energy values.

The spent liquor contains almost all of the inorganic cooking chemicals along with lignin and other organic matter separated from the lignocellulosic material. The initial concentration of weak spent liquor is about 15% dry solids in an aqueous solution. It is concentrated to firing conditions in evaporators and concentrators to a solids content ranging from about 65% to about 85%.

The spent liquor from the process of the present invention does not contain a significant quantity of sulfur compounds and consequently there is no specific reduction work needed to form reduced sulfur species as in a kraft recovery system. Chemicals recovery can be performed under oxidizing or reducing conditions, however it is preferred to recover the chemicals under reducing conditions for optimum recovery of high grade heat and power.

A recovery system based on gasification or partial oxidation of the cellulose spent liquors generated in the processing stages of the present invention has significant advantages relative to recovery of the chemicals in standard recovery boilers.

Gasification of carbonaceous material for the recovery of energy and chemicals is a well established technology and three basic process concepts are normally used: fixed bed gasification, fluidized bed gasification and suspension or entrained flow gasification. Cellulose spent liquors contains a large fraction of alkali compounds with a low melting and agglomeration point and although various fluidized bed concepts have been disclosed for conversion of cellulose spent liquors, it is generally agreed that a suspension or entrained flow gasifier is more suitable for conversion of the highly alkaline liquor. Fixed bed gasifiers are not practical for conversion of liquid fuels.

Gasification or partial oxidation of black liquor in suspension bed gasifiers is presently being introduced on the market for recovery of chemicals and energy from kraft spent liquor. Gas generators of this type can advantageously be used for the recovery of chemicals from the spent cellulose liquors generated during the manufacturing of the chemical pulp in accordance with the present invention. The spent liquors can either be combusted completely in the gas generator or more preferably they can be partially oxidized in order to obtain a combustible gas. More specifically, a chemicals recovery system of the foregoing character would have the desired capability of recovering the chemicals and chemical reagents used in the oxygen delignification process of the present invention. Furthermore, recovery through partial oxidation of cellulose spent liquors provides better thermal efficiency and is substantially more cost effective relative to the traditional recovery boiler system.

Several types of gasifiers can be used, with minor modifications, in the practice of the present invention including, for example, the gasifiers described in U.S. Pat. No. 4,917,763, U.S. Pat. No. 4,808,264 and U.S. Pat. No. 4,692,209. These gasification systems are, however, optimized for chemicals and energy recovery from high sulfidity cellulose spent liquors. The sulfur chemicals are recovered as alkali sulfides but a substantial portion of the sulfur will also follow the raw fuel gas as hydrogen sulfide and carbonyl sulfide. Entrained molten alkaline chemicals in the raw fuel gas are separated from the gas stream in a cooling and quenching stage and dissolved in an aqueous solution. The alkaline solution, called green liquor, is causticized with lime to obtain a high alkalinity white liquor, the traditional chemical used in kraft pulping operations.

Partial oxidation of hydrocarbonaceous materials such as coal, vacuum residues and other heavy hydrocarbons is common practice in the chemicals and petrochemicals industry and several types of gasifiers have been developed and commer mercialized. A number of these gasifiers can, with modifications mainly related to reactor material selection and hot gas cooling design, be used in the following invention, such gasifiers exemplified by that described in U.S. Pat. No. 4,074,981.

Two stage reaction zone up draft gasifiers designed for gasification of heavy hydrocarbons and coal can, with minor modifications, advantageously be used in the practice of the present invention, such gasifiers described in e.g. U.S. Pat. No. 4,872,886 and U.S. Pat. No. 4,060,397.

Another gasifier with a suitable design for use in the present invention is disclosed in U.S. Pat. No. 4,969,931.

While it is preferred to use a gasification system for recovery of chemicals and energy in the present invention, a modern recovery boiler may also be used efficiently, in particular when the new process is implemented in an existing kraft mill.

The cellulose spent liquor of the present invention is mainly composed of hydrogen, carbon, oxygen, nitrogen, iodine and alkali metal compounds. The sulfur content of the liquor is low and as sulfur constitutes a non process element in the overall chemical pulping and chemicals recovery process of the present invention, external sulfur chemicals should not be used in any position in this process. Non process sulfurous components can, if necessary, be bled out from the chemical liquor loop continuously or from time to time.

Although gasification or partial oxidation is the preferred route for recovery of chemicals in the present invention, the liquor can also be completely oxidized in the gas generator and the hot raw gas comprising carbon dioxide and steam, after separation of alkaline compounds, cooling and optional removal of trace contaminants and particulates, is discharged to the atmosphere. Complete oxidation of the final spent liquor stream may be particularly advantageous when lignin and other organic materials have been extracted from spent or circulating liquors resulting in a lower calorific content of the final spent liquor stream and for recovery applications in smaller pulp mills and non-wood operations.

During gasification the cellulose spent liquor is reacted with an oxygen containing gas in a down-flow or up-flow designed gas generator at a temperature in the range of approximately 700° C. to 1300° C. and a pressure in the range of about 0.1 MPa to about 10 MPa, more preferably from about 1.8 to about 4.0 MPa, to produce a raw fuel gas stream comprising at least two of $H_2$, CO, $CO_2$, $H_2O$ and $NH_3$ and a smelt or aerosol comprising one or more materials from the group of transition metal salts, iodine compounds and molten droplets of sodium or potassium compounds or an aerosol of sodium or potassium compounds.

The term oxygen containing gas, as used herein is intended to include air, oxygen-enriched air; i.e. greater than 21 mole % oxygen, and substantially pure oxygen, i.e. greater than 95 mole % oxygen, the remainder comprising $N_2$ and rare gases. Oxygen containing gas may be fed to the gas generator at a temperature in the range from ambient to about 200° C.

The cellulose spent liquor is usually preheated to a temperature in the range of 100 to 150° C., generally to a temperature of at least 120° C. before it is passed into the reaction zone of the partial oxidation gas generator by way of one or more burners equipped with atomizing nozzles. Oxygen, nitrogen, steam or recycled fuel gas or combinations of these gases can be used to support the atomization of the cellulose spent liquor in to a spray of small droplets.

In applications wherein the spent liquor is partially oxidized in the gas generator, the sum of the oxygen atoms in the oxygen containing gas plus the atoms of organically combined oxygen in the solid carbonaceous fuel per atom of carbon in the cellulose spent liquor feed (O/C atomic ratio) corresponds to about 30–65% of the stoichiometric consumption for complete combustion of the spent liquor. With substantially pure oxygen feed to the gas generator, the composition of the raw fuel gas from the gas generator in mole % dry basis may be as follows: $H_2$ 25 to 40, CO 40 to 60, $CO_2$ 2 to 25, $CH_4$ 0.01 to 3, and $NH_3$ 0.1 to 0.5%. The calorific value of the raw fuel gas or the energy in the raw fuel gas as a function of wood charged to the pulping process is highly dependent on the oxidant and the degree of wet combustion in the oxidative delignification stages of the present invention. A typical raw gas higher heating value using pure oxygen as oxidant would be on the order of 6–10 $MJ/Nm^3$ dry gas.

Product gases issuing from the gas generation zone contain a large quantity of physical heat. This heat may be employed to convert water to steam by direct contacting of the hot gas stream with an aqueous coolant in a quench located before or after the separation of entrained molten droplets.

After quenching, the raw fuel gas is cooled in one or more heat exchange zones for recovery of useful steam and heat and the raw gas is thereafter cleaned from contaminants such as particulate matter and alkali metal compounds before it is discharged for final combustion in a boiler or gas turbine combustor.

The majority of smelt formed during gasification of the cellulose spent liquor can be separated either in a single stage wet quench gas cooling system or by quenching in two or more stages at successively lower temperatures. The quenching may be effected by the injection of gaseous or liquid coolants into the hot raw gas stream.

A variety of elaborate techniques have been developed for quenching and cooling gaseous streams from gasification of hydrocarbons and coal, the techniques in general being characterized by the design of the quench and associated heat exchange systems. An alternative arrangement used in many commercial gasification plants is to install a waste heat boiler in connection with the gas generator raw gas outlet.

Another and more preferred design for the separation of raw gas and molten salts in the recovery system of the present invention is by separating a substantial fraction of the molten alkaline material by gravity or by other means in a separate gas diversion and smelt separation zone arranged in or adjacent to the gas generator, such separation being effected without substantially reducing the temperature of the hot gas stream. In this particular embodiment an up flow or updraft type of gas generator could be used. The cellulose spent liquor can for example be contacted with the oxygen containing gas in a horizontally fired slagging reactor with smelt discharge in a lower section and withdrawal of raw gas in the upper section of the gas generator. The hot gases generated in a first reaction zone may be contacted by an additional increment of cellulose spent liquor in a vertical unfired second reaction zone connected to the upper end of the first reaction zone. The heat evolved in the first reaction zone is used in the second reaction zone to convert the second increment of cellulose spent liquor into more fuel gas. Any carry over of entrained particulates or droplets can be separated from the gas by quenching or scrubbing.

Regardless of the type and design of gasifier or gas generator, the inorganic molten droplets and aerosols forrned in the gas generator are separated from the raw gas and dissolved in an aqueous solution. The solution comprises the alkaline compounds in a form suitable for direct use as buffer alkali in the oxygen delignification and/or precooking stages of the present invention. The alkalinity of the recovered buffer liquor is not as critical as in the recovery of kraft liquors where a high initial alkalinity is desired to minimize causticizing and lime reburning load.

The buffer alkali thus obtained comprises alkali metal carbonates and alkali metal hydrogen carbonates and optionally iodine compounds such as sodium iodide and potassium iodide. In addition, the buffer alkali may contain transition metal compounds such as cupric chlorides, cupric iodide, manganous carbonate, cobalt and ferric compounds and magnesia compounds such as magnesium carbonate or hydroxide.

The liquor is withdrawn from the quench or dissolving vessel, optionally after heat exchange or flashing, to a device for removal of certain non process elements, such as silica and aluminum compounds. These elements should be removed from the liquor before the liquor is recycled to the precooking and/or oxygen delignification stages. Such a non process element removal device can be a high pressure filter of the compact disc type, a cross flow filter, a centrifuge, an ion exchange device, or a gravity separation device with or without support from flocculants or surface active agents.

The clarified liquor comprising the alkaline buffer chemicals and active chemical substances or their precursors can be subjected to an oxidative treatment with an oxygen containing gas to activate chemical reagents, catalysts or carbohydrate protectors and/or to eliminate any traces of sulfide before the liquor is recycled and charged to the desired pretreatment, precooking or oxygen delignification stage of the present invention.

When practicing the present invention in pulp mills operating with certain softwood feed materials it may become necessary to causticize a substantial portion of the recovered alkali to increase alkalinity of the buffer liquor for recycle and use in a precooking stage.

The combustible raw fuel gas generated during gasification may be used to fuel steam generators or used as fuel in advanced gas turbine cycles. The fuel gas can also partly or fully be used as a synthesis gas for the manufacture of hydrogen or liquid hydrocarbons.

While gasification or full combustion of the waste liquors generated in the process of the present invention in a specially designed gasification or oxidation reactor is preferred, a traditional recovery boiler may also be used for chemicals recovery particularly when converting a modem existing kraft mill to the new process.

In one of the preferred chemicals recovery embodiments of the present invention, a portion of the lignin and other organic material is extracted and separated from a spent liquor stream or digester circulation stream before concentration and discharge of said stream to recovery bf cooking chemicals. Such substantially sulfur chemicals free lignin and organic material may be recovered in accordance with prior art lignin recovery technologies and used as a raw material or precursor for use in fine chemicals and engineering plastics manufacturing or as low sulfur biofuel. The lignin and other organic material is preferably precipitated from cellulose waste liquors with solids content in the range of 3–30% supported by the action of an acid, preferably carbon dioxide recovered from gases with the origin from combustion of cellulose spent liquor.

DESCRIPTION OF THE DRAWING

A more complete understanding of the invention may be had by reference to the accompanying drawing which in FIG. 1 illustrates a preferred embodiment of the present invention as practiced in a hardwood pulp mill and which represents the best mode contemplated at present for carrying out the invention.

Figure 1:
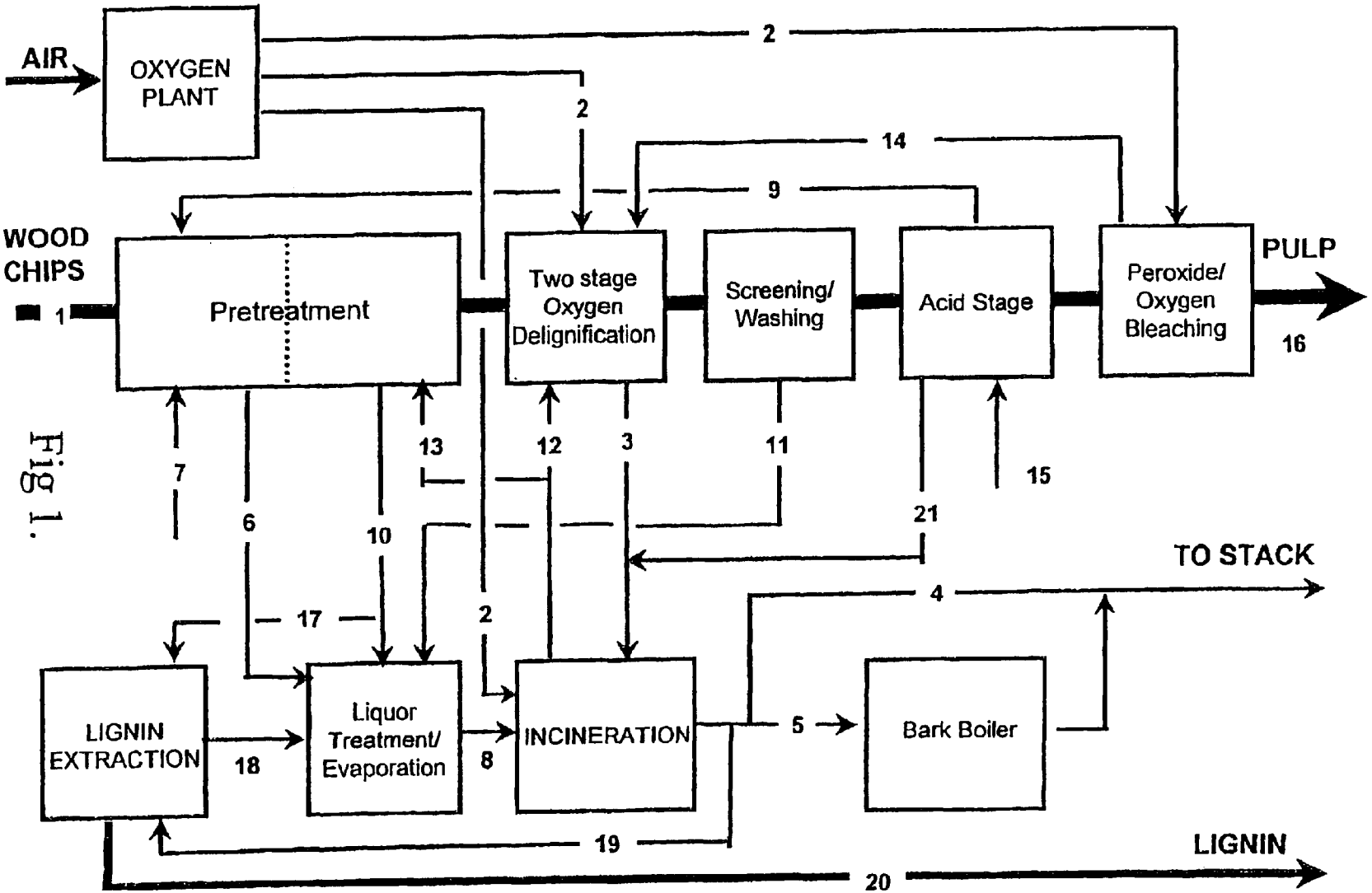
In FIG. 1 wood chips 1 or other finely comminuted cellulosic fibrous material is charged to a first compartment in a pretreatment stage for treatment with steam and a pulping catalyst added through line 7. A partly neutralized bleach plant filtrate is recycled from an acid stage in the bleach plant to the first compartment in the pretreatment reactor system through line 9. Excess pretreatment liquor is discharged through line 6.

The material treated with steam and catalyst is transferred to a second compartment in the pretreatment stage wherein the lignocellulosic material is subjected to treatment with an alkaline buffer solution at a temperature of 150 C. Lignin is extracted from the fibrous material and dissolved in the alkaline buffer solution. Fresh alkaline buffer solution is added to the pretreatment reactor system through line 13. Spent liquor comprising dissolved lignin fragments and spent pulping chemicals are extracted from the pretreatment stage and discharged through line 10 and combined with other spent cellulose liquors for subsequent concentration in an evaporation plant. A stream of at least partially delignified cellulosic material is transferred to a two stage oxygen delignification plant wherein the lignocellulosic material is subjected to treatment with oxygen in the presence of an alkaline buffer solution added through line 12, said alkaline buffer solution also comprising a transition metal catalyst and a magnesia based carbohydrate protector. Alkaline bleach plant filtrate is recycled to the oxygen delignification stage through line 14. Gases evolved during oxygen delignification and surplus oxygen are removed from the oxygen delignification reactor through line 3.

The chemical raw pulp material obtained after oxygen delignification is screened for removal of oversized material, washed and transferred to a bleach plant cornprising an acidic ozone stage. Ozone gas is added to the ozone stage through line 15 from an onsite ozone plant. Gases evolved during ozonization of the pulp and surplus ozone is discharged through line 21. The pulp is thereafter finally bleached in a pressurized alkaline peroxide stage in order to obtain a strong pulp product 16 at full brightness.

A portion of the spent liquor stream 10 is diverted and passed through line 17 to a lignin extraction plant wherein lignin an/other organic material is precipitated from the liquor. Lignin precipitation is enforced through the action of carbon dioxide gas recovered from the incinerator flue gas and passed to the lignin extraction plant through line 19. Remaining spent liquor is discharged from the lignin extraction plant and passed through line 18 to the liquor treatment and concentration unit Lignin value material is removed through line 20.

The wash filtrate 11 is combined with other filtrates and spent liquors in the liquor treatment evaporation facility for concentration to a high solids content. A concern trated cellulose spent liquor is discharged from the evaporator facility through line 8 to an incinerator plant wherein the spent liquor is combusted under pressure to form a hot gas and an alkaline aqueous solution. The alkaline solution comprises valuable chemicals such as sodium compounds and may contain a transition metal catalyst and a carbohydrate protector or their precursors. The alkaline aqueous solution is after optional treatment with oxygen and non process element removal, recycled to the precooking or oxygen delignification stages through lines 12 and 13.

Oxygen is manufactured in a cryogenic on site oxygen plant and supplied through separate lines 2 to the oxygen delignification stage, the bleachplant, the gasification reactor and as may be the case, to other oxygen users in the mill such as for example an ozone plant. Rest gases from the oxygen delignification stage is compressed and charged into the spent liquor incinerator through line 3.

The hot gas formed during combustion of the spent liquor in the incinerator is cooled for the recovery of latent and physical heat and transferred through line 5 to a bark or hog fuel boiler for final oxidation or altematively, if oxidation in the incinerator is complete, the gas may be discharged to the atmosphere through a stack 4.

It is thus documented a process performed in several unit operations for the manufacturing of a chemical pulp from lignocellulosic material and the recovery of chemicals used in said process.

While the methods and apparatus herein described constitute preferred embodiments of the invention, other modifications and variations of the invention as herein before set forth may be made without departing from the spirit and scope thereof, and therefore only such limitations should be imposed on the invention as are indicated by the appended claims.

What is claimed is:

1. A substantially sulfur-free process for the production of a chemical pulp from lignocellulosic material and the recovery of chemicals used in said process comprising the steps of:

a) providing a feed stream of comminuted lignocellulosic material, b) subjecting said feed stream of comminuted lignocellulosic material to a pretreatment, c) reacting the pretreated lignocellulosic material from step b) with oxygen or oxygen-containing gas, in the presence of an alkaline buffer solution comprising at least one sodium or potassium compound in order to obtain a stream of at least partially delignified lignocellulosic material, d) further treating said at least partially delignified material from step c) to obtain a chemical pulp product, e) extracting spent liquor comprising dissolved lignin components and spent chemical substances from step b) or both steps b) and c), f) recovering chemical substances from the spent liquor obtained in step e) and preparing fresh alkaline buffer solution to be charged to step c) or both steps c) and b), wherein in step b) said comminuted lignocellulosic material is subjected to a mild prehydrolysis in an aqueous solution and thereafter precooked in the presence of an alkaline buffer solution, and in step b) an aromatic organic compound is added to promote selective delignification, and in step f) the recovery of chemical substances from the spent liquor obtained in step e) comprises, $f_1$) treating at least part of said spent liquor to form a concentrated stream of cellulose spent liquor, $f_2$) reacting said concentrated cellulose spent liquor stream with an oxygen containing gas at elevated temperature in a gas generator to form a hot gas comprising carbon dioxide and molten droplets of sodium or potassium compounds or an aerosol of sodium or potassium compounds, $f_3$) dissolving said sodium or potassium compounds in water to form an alkaline buffer solution and $f_4$) recycling and charging at least a portion of said alkaline buffer solution to step c) or both steps c) and b).

2. A process according to claim 1, wherein at least one agent active in enhancing selective delignification is added to the oxygen delignification step c), and wherein at least a part of said agent or its precursor is formed or recovered from step f) and recycled to step c).

3. Process according to claim 2, wherein said agent is a carbohydrate protector comprising at least one of magnesium and silicon compounds, hydrazines, boron hydride of alkaline metals and iodine compounds.

4. A process according to claim 1, wherein said mild prehydrolysis in step b) is being effected by the addition of steam to a vessel comprising the lignocellulosic material, or by steam addition to an aqueous slurry of the lignocellulosic material.

5. A process according to claim 4, wherein the temperature during said mild prehydrolysis is maintained between 50 and 120° C. under a time period of 20 to 80 min.

6. A process according to claim 4, wherein the temperature during said mild prehydrolysis is maintained between 50–150° C. under a time period of about 5 to 140 minutes.

7. A process according to claim 6, wherein a filtrate recycled from a bleach plant is added to the mild prehydrolysis stage in step b).

8. A process according to claim 1 wherein precooking of the lignocellulosic material in step b) is performed in a temperature range from about 110° C. to about 200° C. for a period of about 3 minutes to about 6 hours in order to obtain an at least partly delignified lignocellulosic material.

9. Process according to claim 8, wherein the alkaline buffer solution primarily is made up of at least one of alkali metal hydroxides, alkali metal carbonates, alkali metal borates and alkali metal phosphates.

10. Process according to claim 1, wherein an aromatic organic compound added in step b) is a delignification catalyst comprising anthraquinone or a derivative of anthraquinone.

11. Process according to claim 1, wherein an aromatic organic compound is added to the mild prehydrolysis stage in step b), said aromatic compound being selected form 2-naphthol, xylenol anthraquinone or a derivative of anthraquinone.

12. Process according to claim 1, wherein the comminuted lignocellulosic material is treated in step b) with an active oxygen compound selected from the group consisting of chlorine dioxide, ozone, oxygen, hydrogen peroxide and a peroxyacid in order to oxidize at least a portion of the lignin before the material is treated with oxygen in step c).

13. Process according to claim 1, wherein lignocellulosic material is subjected to mechanical defiberization before step c), said mechanical defiberization being effected by an energy input ranging from about 50 to about 500 kWh/ton of dry cellulosic material.

14. Process according to claim 1, wherein oxygen delignification is performed in the presence of an alkaline buffer largely made up of alkali carbonate or alkali borate, and wherein such buffer originates in the chemicals recovery system and is transferred and used in said oxygen delignification without having been subjected to causticizing.

15. Process according to claim 14, wherein oxygen delignification is performed in the presence of at least one chemical reagent, said reagent being selected from one or more of a carbohydrate protector, a transition metal catalyst with a central atom selected from copper, manganese, iron, cobalt or ruthenium.

16. Process according to claim 15, wherein a transition metal catalyst forms a complex with a ligand comprising nitrogen.

17. Process according to claim 16, wherein said transition metal catalyst forms a complex with ammonia, triethanolamine, phenanthroline, bipyridyl, pyridine, triethylenetetraamine, diethylenetriamine, acetylacetone, ethylenediamine, cyanide and oxyquinolines.

18. Process according to claim 16, wherein a transition metal catalyst is present during oxygen delignification in a concentration ranging from about 10 ppm to about 5000 ppm calculated on basis of dry lignocellulosic material.

19. Process according to claim 1, wherein oxygen delignification is performed in the presence of a carbohydrate protector comprising an organic radical scavenger, a magnesium or an iodine compound or combinations thereof.

20. Process according to claim 19, wherein the magnesium compound is selected from magnesium compounds soluble in alkaline solutions.

21. Process according to claim 19, wherein an iodine compound is present in a concentration corresponding to 1 to 15% calculated on the lignocellulosic material.

22. Process according to claim 19, wherein an organic radical scavenger is an alcohol, amine or a ketone or combinations thereof.

23. Process according to claim 22, wherein amines comprise ethanolamines and ethylenediamine, alcohols comprise methanol, ethanol, n-propanol, isobutyl alcohol, neopentyl alcohol and resorcinol, and ketones comprise acetone.

24. Process according to claim 19, wherein the organic radical scavenger is present in a concentration from 0.1% to about 10% on dry cellulosic material.

25. Process according to claim 19, wherein an iodine compound is present in a concentration corresponding to 3–8% calculated on the lignocellulosic material.

26. Process according to claim 19, wherein the organic radical scavenger is present in a concentration from about 0.5 to about 3% on dry cellulosic material.

27. Process according to claim 1, wherein a polyelectrolyte or a surface active agent or combinations of polyelectrolytes and surface active agents are added in step c) in order to increase and facilitate mass transfer of oxygen in an oxygen delignification stage.

28. Process according to claim 27, wherein a polyelectrolyte is selected from cross-linked polyelectrolytes including phosphazenes, imino-substituted polyphosphazenes, polyacrylic acids, polymethacrylic acids, polyvinyl acetates, polyvinyl amines, polyvinyl pyridine, polyvinyl imidazole, and ionic salts thereof.

29. Process according to claim 27, wherein a surface active agent is selected from non ionic or zwitterionic compounds including poly(ethyleneoxy)/(propyleneoxy) block copolymers, fatty acids and fatty amines which have been ethoxylated; polyhydroxyl non-ionic (polyols) and a quaternized poly(propylene glycol) carboxylate or lecithin.

30. Process according to claim 27, wherein a high molecular weight polyethyleneglycol is added to an alkaline buffer liquor or to an oxygen delignification stage in a quantity on the order of 0.2 percent or les on the lignocellulosic material in order to reduce the viscosity of the pulping liquor.

31. Process according to claim 1, wherein an oxygen delignification stage is carried out in consistencies ranging from about 1 to 30%.

32. Process according to claim 1, wherein a lignocellulosic material treatment using oxygen compounds is carried out in a pressurized diffuser reactor.

33. Process according to claim 1, wherein:

in step b) anthraquinone, 2-naphtol or xylenol or derivatives thereof is added to be present during the pretreatment, and in step c) said alkaline buffer substantially is made up of an alkali carbonate or an alkali borate or combinations thereof, and in step $f_2$) said concentrated spent cellulose liquor from step $f_1$) is reacted with an oxygen containing gas in a reaction zone of a gas generator at a temperature in the range of 700–1300° C. to produce a hot raw gas comprising carbon dioxide and at least one of $H_2$, CO, $H_2O$, and $NH_3$, said raw gas containing entrained molten particulate matter and an aerosol of alkaline compounds, and at least a major portion of said entrained particulate molten matter being separated from the raw gas stream and dissolved in an aqueous solution to form an alkaline solution comprising sodium or potassium compounds, and wherein at least a portion of said alkaline solution is recycled to the oxygen delignification step c), without having been subjected to causticizing.

34. Process according to claim 33, wherein said hot raw gas is cooled and cleaned to produce a clean gas stream substantially free from particulate matter and alkali metal compounds.

35. Process according to claim 33, wherein a major portion of the entrained particulate molten matter is separated from the raw gas by gravity in a gas diversion and smelt separation zone arranged in or adjacent to the gas generator, said separation being effected without substantially reducing the temperature of the hot gas stream.

36. Process according to claim 33, wherein a gas generator is an updraft gasifier with smelt removal in a lower section of the gas generator and wherein the hot raw fuel gas is discharged from an upper section of the gas generator.

37. Process according to claim 33, wherein the addition of oxygen containing gas to the gas generator corresponds to 30–65% of stoichiometric complete combustion of the cellulose spent liquor.

38. Process according to claim 33, wherein the pressure in the gas generator ranges from about 0.1 MPa to 10 MPa.

39. Process according to claim 34, wherein cellulose spent liquor is completely oxidized in the gas generator or reactor and wherein hot raw gas comprising carbon dioxide and steam, after separation of alkaline compounds, cooling and optional removal of trace contaminants and particulates, is discharged to the atmosphere.

40. Process according to claim 1, wherein an alkaline buffer solution comprising sodium or potassium compounds is subjected to an oxidative treatment with an oxygen containing gas in order to activate chemical reagents, catalysts or carbohydrate protectors and/or to eliminate any traces of sulfide before the alkaline buffer solution is recycled as desired to a pretreatment, precooking or an oxygen delignification stage.

41. Process according to claim 1, wherein:

a portion of the lignin and other organic material in a cellulose spent liquor stream from step b) or c) or a digester circulation stream is extracted and separated from the spent liquor stream or digester circulation stream before it is discharged to concentration or combustion in order to recover substantially sulfur chemicals free lignin and other organic material, a spent liquor stream recovered after extraction of lignin another organic material is discharged and withdrawn to be further processed in a recovery system according to steps $f_1$) to $f_4$) to recover inorganic chemicals, chemical reagents or chemical reagent precursors and energy values.

42. Process according to claim 1, wherein lignocellulosic material is subjected to mechanical defiberization before step c), said mechanical defiberization being effected by an energy input ranging from about 50 to 300 kWh/ton of dry cellulosic material.

* * * * *